US009615441B2

(12) United States Patent
Bromberg et al.

(10) Patent No.: US 9,615,441 B2
(45) Date of Patent: Apr. 4, 2017

(54) PHASE-LOCK LOOP SYNCHRONIZATION BETWEEN BEAM ORBIT AND RF DRIVE IN SYNCHROCYCLOTRONS

(71) Applicant: Massachusetts Institute of Technology, Cambridge, MA (US)

(72) Inventors: Leslie Bromberg, Sharon, MA (US); Joseph V. Minervini, Still River, MA (US); Alexey L. Radovinsky, Cambridge, MA (US); Phillip C. Michael, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/161,377

(22) Filed: May 23, 2016

(65) Prior Publication Data

US 2016/0270204 A1 Sep. 15, 2016

Related U.S. Application Data

(63) Continuation of application No. 13/949,459, filed on Jul. 24, 2013.

(Continued)

(51) Int. Cl.
*H05H 13/02* (2006.01)
*H05H 7/10* (2006.01)

(Continued)

(52) U.S. Cl.
CPC ..... *H05H 13/02* (2013.01); *H05H 7/02* (2013.01); *H05H 7/10* (2013.01); *H05H 13/005* (2013.01); *H05H 2007/025* (2013.01)

(58) Field of Classification Search
CPC ..... H05H 13/00; H05H 13/005; H05H 13/02; H05H 7/00; H05H 7/02; H05H 7/08; H05H 7/10

(Continued)

(56) References Cited

U.S. PATENT DOCUMENTS 3,227,957 A 1/1966 Feldmann
4,641,057 A * 2/1987 Blosser ..... H05H 7/20 313/62

(Continued)

FOREIGN PATENT DOCUMENTS

CN 101061759 A 10/2007
EP 0351970 A1 1/1990

(Continued)

OTHER PUBLICATIONS

International Search Report and Written Opinion mailed Dec. 13, 2013 in corresponding PCT application No. PCT/US13/51942.
European communication dated Nov. 24, 2015 in corresponding European patent application No. 13823240.0.
Chinese communication, with English translation, dated Apr. 6, 2016 in corresponding Chinese patent application No. 201380050677A.

(Continued)

*Primary Examiner* — Lincoln Donovan
*Assistant Examiner* — David Mattison
(74) *Attorney, Agent, or Firm* — Nields, Lemack & Frame, LLC

(57) ABSTRACT

The invention specifies the use of feedback in the radio frequency (RF) drive for a synchrocyclotron, controlling the phase and/or amplitude of the accelerating field as a means to assure optimal acceleration of the beam, to increase the average beam current and to alter the beam orbit in order to allow appropriate extraction as the beam energy is varied. The effect of space charge is reduced by rapid acceleration and extraction of the beam, and the repetition rate of the pulses can be increased. Several means are presented to monitor the phase of the beam in synchrocyclotrons and to adjust the phase and amplitude of the RF to optimize the acceleration of the beam and to adjust the extraction and injection of the beam. Also, the use of a pulsed ion source that matches the acceptance window of the synchrocyclotron is described.

20 Claims, 12 Drawing Sheets

Related U.S. Application Data

(60) Provisional application No. 61/676,377, filed on Jul. 27, 2012.

(51) Int. Cl.
*H05H 7/02* (2006.01)
*H05H 13/00* (2006.01)

(58) Field of Classification Search
USPC ..... 315/502
See application file for complete search history.

(56) References Cited

U.S. PATENT DOCUMENTS

| | | | | |
|---|---|---|---|---|
| 5,001,437 | A | 3/1991 | Miyata et al. | |
| 5,440,210 | A | 8/1995 | Bogaty et al. | |
| 7,626,347 | B2 | 12/2009 | Sliski et al. | |
| 2007/0001128 | A1 | 1/2007 | Sliski et al. | |
| 2009/0140671 | A1* | 6/2009 | O'Neal, III | H05H 13/02 315/502 |
| 2010/0045213 | A1* | 2/2010 | Sliski | H05H 13/02 315/502 |
| 2010/0171047 | A1* | 7/2010 | Matsuda | A61N 5/1043 250/492.3 |
| 2014/0028220 | A1 | 1/2014 | Bromberg et al. | |

FOREIGN PATENT DOCUMENTS

| | | | |
|---|---|---|---|
| JP | 11-329800 | A | 11/1999 |
| WO | 2012/031299 | A2 | 3/2012 |

OTHER PUBLICATIONS

The Physical Review, Second Series, vol. 72, No. 8, Oct. 15, 1947, pp. 649-661, with particular attention to Figure 4 on p. 656, "Theory of the Synchro-Cyclotron", Bohm, et al.

Particle Accelerators, McGraw-Hill Book Company, Inc., 1962, 683 pages, Livingston, et al. (submitted in two parts).

Review of Scientific Instruments, 83, 02B318 (2012), doi: 10.1063/1.3675385, "A study of H+ production using metal hydride and other compounds by means of laser ion source", 4 pages, Sekine, et al.

Review of Scientific Instruments, 83, 02B310 (2012), doi: 10.1063/1.3671740, "Proton emission from a laser ion source", 4 pages, Torrisi, et al.

Review of Scientific Instruments, 83, 02B315 (2012), doi: 10.1063/1.3673506, "Proton emission from thin hydrogenated targets irradiated by laser pulses at 10-16 W/cm2", 5 pages, Torrisi, et al.

Kleeven et al, "The Self-Extracting Cyclotron", Proceedings of 16th International Conference on Cyclotrons ANS Applications, 2001, pp. 69-73, XP002750810.

Office action mailed May 20, 2015 in co-pending U.S. Appl. No. 15/161,377.

Notice of Allowance mailed Feb. 29, 2016 in co-pending U.S. Appl. No. 15/161,377.

Office action mailed Jun. 30, 2016 in co-pending U.S. Appl. No. 15/161,377.

Notice of Allowance mailed Nov. 22, 2016 in co-pending U.S. Appl. No. 13/949,459.

* cited by examiner

PHASE-LOCK LOOP SYNCHRONIZATION BETWEEN BEAM ORBIT AND RF DRIVE IN SYNCHROCYCLOTRONS

This application is a continuation of U.S. patent application Ser. No. 13/949,459 filed Jul. 24, 2013, which claims priority of U.S. Provisional Application Ser. No. 61/676,377, filed Jul. 27, 2012, the disclosures of which are incorporated herein by reference in its entirety.

BACKGROUND

Ion acceleration using synchrocyclotrons is a mature technology that is well suited to produce high energy, but relatively low average ion beam currents. Acceleration is achieved by applying high frequency (typically radio frequency (RF)) electric fields to an ion beam packet as it spirals outward from the center of an axisymmetric, static magnetic field. It is well known that the frequency of the RF drive in synchrocyclotrons needs to be adjusted as the ion beam is being accelerated. The RF drive can be extended to include the variable frequency RF generator, RF power amplifier or amplifiers, and a structure or structures inside the magnetic field (such as RF cavities or dees) where the acceleration electric field is applied to the ion beam packet. Because the RF frequency varies during acceleration, typically there is only one bunch of ions in the device at any one time. The cyclotron frequency varies to compensate for changes to the relativistic mass of the accelerated particles as their energy increases during acceleration and the fact that the magnetic field is varying radially in order to provide beam focusing. The magnetic field in the bore of the machine needs to satisfy the following requirements for orbit stability. The value of the magnetic field needs to decrease with increasing radius, while keeping the value of $$0<2\nu_z<0.5\nu_r$$

where $$\nu_z=n^{1/2},$$

$$\nu_r=(1-n)^{1/2},$$

and $$n=-d\log(B)/d\log(r)$$

over the accelerating region, and it needs to rise quickly with radius in the extraction region.

A body of literature exists on the control of the frequency of the RF acceleration. The object of the prior art has been to adjust the RF frequency to match the cyclotron frequency of the ion beam, while monitoring changes to the beam current after extraction. In addition, another object of the prior art has been to match a resonant circuit and the RF drive that it generates to the required frequency. No effort has been made to either monitor the phase of the ion beam orbits relative to the phase of the RF drive, or to adjust the phase and amplitude of the RF drive and the ion beam during injection, acceleration or extraction. In this case, the amplitude of the RF drive actually refers to the magnitude of the acceleration electric field applied to the beam by the RF structures. It is well known that if the relative phase between the ion beam orbit and the RF drive results in a substantial phase difference, the RF drive does not increase the beam energy, but instead decreases the energy of the ion beam by extracting energy from it. The ion beam continues to lose energy until it has drifted enough in phase and frequency to again match that of the RF drive: as the particles are decelerating, they are moving into regions of increasing magnetic field (at smaller radii) that require increased frequency for synchronism, but the applied RF field is decreasing in frequency, so the particles eventually slow down enough to the point where they are again in phase with the RF field and resume acceleration. Although eventually the beam packet gets accelerated, the beam quality suffers and the average beam current decreases. It would be best if the phase of the RF drive and the phase of the beam orbits were synchronized throughout the injection, acceleration and extraction process, especially for conditions where the final beam energy is varied (by adjusting the current in the cyclotron coils). For operation, the currents in all the coils in the cyclotron are varied by the same ratio which is adjusted in order to vary the final energy of the beam. It is usually that only about 50% of the electric field from the RF drive is accessible for beam acceleration in a conventional machine.

For synchrocyclotrons that use significant quantities of iron to generate and shape the acceleration field, changes to the coil currents (for example, to change the beam energy) change not only the intensity of the magnetic field, but also the magnetic field profile. Thus, an iron containing cyclotrons is not suitable for producing beams where the extracted beam energy can be varied, without the use of energy degraders or internal targets (for adjusting the charge of the ions).

In synchrocyclotrons, the beam orbits are controlled by the RF drive. This is the case when the frequency of the RF drive varies slowly. When the frequency of the RF increases rapidly (for example, when larger average currents are desired), the beam can lose synchronization with the RF energy, with results being very small acceleration or no current at all. In addition, it would be beneficial to control the RF phase and amplitude during both the injection of the ion beam as well as during the extraction. Injection control can be adjusted externally by pre-bunching the beam, so that it matches the acceptance angle of the cyclotron accelerating field. Control of the pre-buncher would, of course, be coordinated with the phase of the RF drive applied during the initial beam orbits of the acceleration cycle. However, for extraction, the opportunities are very limited. Adjustment of ion energy, phase and location of the ion beam during the last few orbits prior to extraction would allow better extraction efficiencies and minimize loss of beam that impacts radiation safety, heating and radiation damage to internal components. The ability to precisely control beam extraction in synchrocyclotrons is especially important for iron-free machines which can be designed to deliver output beams over a wide range of energies from a single machine without need for energy degraders in the output beam path (through the variation of the current in the cyclotron coils).

Therefore, it is a goal of the present disclosure to be able to directly vary the final energy of the beam extracted from a single cyclotron. A further objective is to maintain a high extraction efficiency regardless of the final beam energy. The variable energy is facilitated by the variation of the current in the cyclotron coils and adjustment of the main fields in the cyclotron. The final beam energy is a function of the magnitude of the magnetic field in the cyclotron.

SUMMARY

Phase lock loop techniques are useful to assure that the beam is extracted efficiently. One means to achieve high extraction efficiency as the energy is varied is to adjust the amplitude, phase (with respect to the beam) and frequency of the RF drive based on continuous monitoring of beam position so that the beam trajectory throughout the acceleration process remains the same regardless of the final beam energy.

A proposed embodiment of the invention specifies phase-locked loop control of at least one of the RF drive, the injection circuit and the extraction circuit, whereby the RF drive (phase, frequency and amplitude), the injection and extraction circuits are controlled throughout the beam injection, acceleration and/or extraction process using information on the beam status. The control loop encompasses the injection of beam packets into the device with proper phase relation relative to the RF acceleration drive and controlled, high-efficiency extraction of an ion beam of desired final energy.

According to another embodiment, a method of creating and extracting an ion beam having a predetermined energy from a cyclotron is disclosed. The method comprises introducing ions into the cyclotron; using a RF drive to accelerate the ions to move as an ion beam in the cyclotron; sensing a position of the ion beam in the cyclotron during the acceleration; using the position of the ion beam to alter the RF drive to maintain a desired acceleration; and actuating a non-axisymmetric pulsed magnetic field (kicker field) to extract the ion beam.

According to another embodiment, a cyclotron is disclosed, which comprises a beam detector disposed so as to detect the presence of an ion beam; a beam sensor in communication with the beam detector; a RF wave generator having a variable phase or frequency output; the output defined as RF drive; a RF cavity or dee in communication with the RF drive; and an electronic control unit in communication with the beam sensor and having outputs in communication with the RF wave generator so as to control the RF drive, thereby controlling velocity and position of the ion beam. In this context the electronic control unit can comprise analog circuits, digital circuits and processors or more typically a hybrid combination of both. In a further embodiment, the cyclotron further comprises a kicker coil to generate a non-axisymmetric pulsed magnetic field to extract the ion beam. In one embodiment, the electronic control unit is in communication with the kicker coil, and actuates the kicker coil when the ion beam reaches a predetermined position and velocity.

BRIEF DESCRIPTION OF THE FIGURES

For a better understanding of the present disclosure, reference is made to the accompanying drawings, which are incorporated herein by reference and in which.

DETAILED DESCRIPTION

Figure 1:
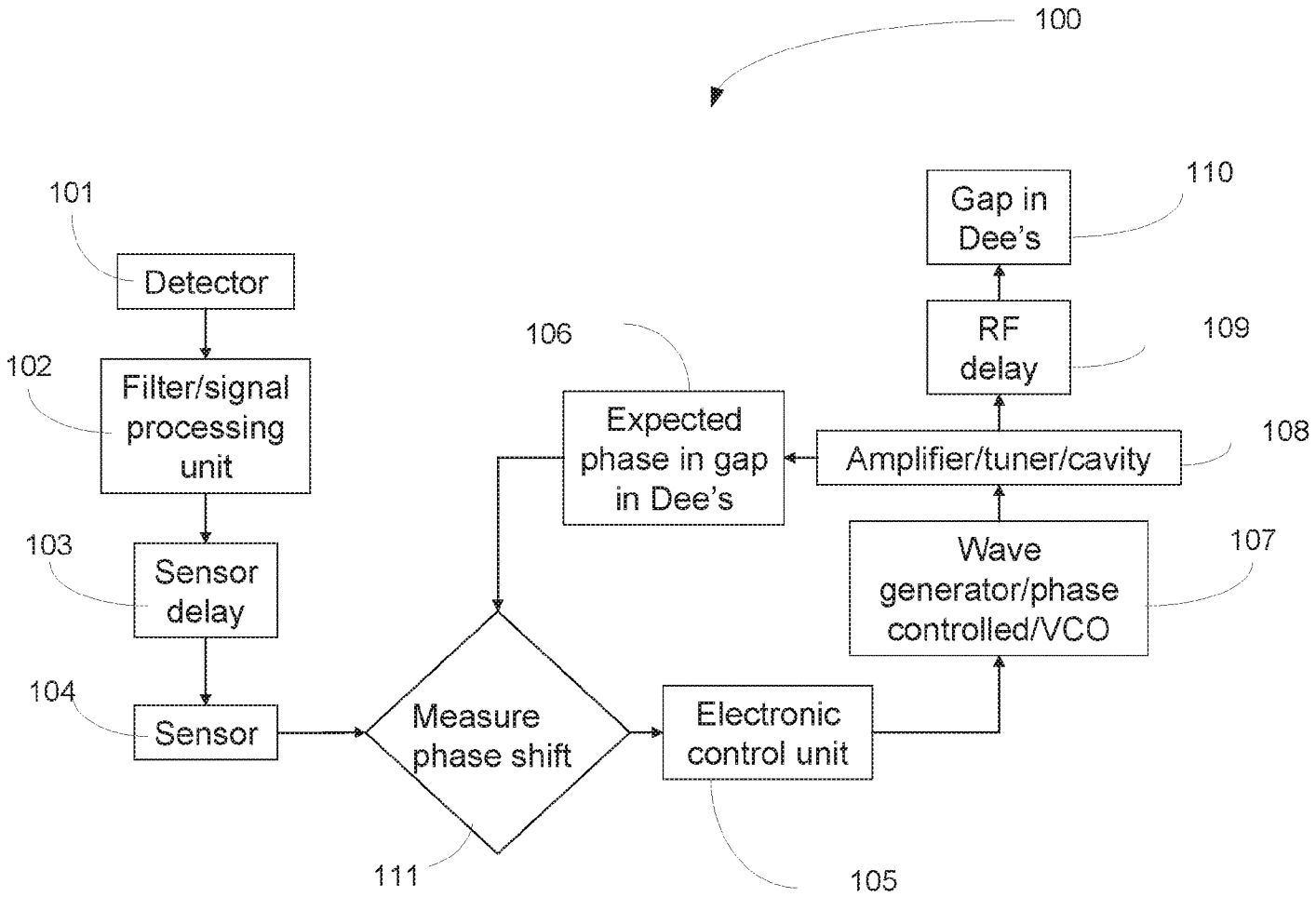
FIG. 1 is a schematic of phase-lock loop control of beam in synchrocyclotron accelerators for optimal beam acceleration, where the phase and/or amplitude of the RF drive is adjusted according beam information.

To determine the beam location and to optimally accelerate, inject and extract the ions, it is desired to synchronize the phase of the RF drive to that of the ion beam orbit, and to adjust the amplitude of the RF field. The steps used for synchronization are described below. The phase of the RF drive, although fixed at the source, varies across the gap (which is defined as the space across the dee's of the device), due to the finite velocity of propagation of the electromagnetic waves and because the acceleration gap can be other than a radial (such as an accelerating gap that varies azimuthal direction as a function of radius). The dee's are electrodes used to generate the RF drive. Although the term "dee" may be used herein, it is understood that this term refers to any mechanism by which RF drive can be injected into the system. In some embodiments, an alternative to the use of dee's is the use of RF cavities. Therefore, unless otherwise indicated, the term "dee" is used to represent both dee's and RF cavities.

At each radial location, the phase of the RF drive can be identified as $\Delta\phi_{RF}$. It is understood that the phase is a function of the radius of the beam. $\Delta\phi_{RF}$ is the phase shift of the RF drive, at any given time, from that of the source. It should be noted that $\Delta\phi_{RF}$ is a function of the radial location of the beam (that is, the energy of the ion beam), depending on how the RF is feed to the accelerating dee's.

To optimally accelerate the ion beam, it is necessary to monitor the real-time phase of the ion beam. It is assumed that the ion beam passes through the detector at times $t_{beam}+\Sigma(2\pi/\omega_n)$, where $\omega_n$ is the cyclotron frequency at the radial location of the ion beam (at the $n^{th}$ turn). As in the case of the RF drive, there is a phase lag between when the ion beam excites the monitoring device (the "detector"), and the point of detection of the phase (the "sensor"). It should be understood that there can be more than one detector element, which, when combined, are identified as "detector." In addition, the azimuthal location of the beam monitoring device is separate from that of the RF drive. The delay from the detector to the sensor is defined as $t_{sensor}$. It is assumed that the phase of the RF wave, at the source, at the time when the ion beam is sensed by the system is $\phi_{source}$. Thus, the electric field at the RF source when the ion beam is sensed by the system is $$E_{source}=\exp[i\omega(t_{beam}+\Sigma(2\pi/\omega_n)+t_{sensor})+i\phi_{source}]$$

In particular, it may be desirable to measure the ion beam phase in an azimuthal location that is under the ground electrode, to minimize signal pick-up due to the RF drive.

After the ion beam crosses the detector, there is a delay until the ion beam reaches the accelerating gap, referred to as $t_{beam\text{-}gap}$. The RF field in the gap, when the beam crosses the gap, is then $$\Sigma_{gap\ beam\ crossing}=\exp[i\omega(t_{beam}+\Sigma(2\pi/\omega_n)+t_{beam\text{-}gap})+i\phi_{source}-i\Delta\phi_{RF}]$$

The negative sign in the RF term is due to the fact that the RF drive at the gap lags the RF drive at the source, by $\Delta\phi_{RF}$.

To maximize the acceleration of the ion beam in a synchrocyclotron, the phase of the RF drive needs to remain synchronized with that of the ion beam orbit. It is known that a relatively narrow range of phase results in the best acceleration of the ion beam, with good phase stability. In particular, the ion beam should cross the accelerating gap while the electric field in the gap is increasing. In this manner, the particles that are lagging the bulk of the beam will be accelerated stronger than the bulk, and they will catch up to the bulk. Similarly, those ahead of the bulk will experience lower electric fields, and thus they will be accelerated less than the bulk and slow down until the bulk catches up with them. The optimal phase of the electric field in the gap for acceleration of the beam is referred to as $\phi_{optimal}$.

Thus, it is desired that the phase of the RF drive, when the beam reaches the gap, is:

$$\omega(t_{beam}+\Sigma(2\pi/\omega_n)+t_{beam\text{-}gap})+\phi_{source}-\Delta\phi_{RF}=\phi_{optimal}$$

Thus, $\phi_{source}$ can be obtained as:

$$\phi_{source}=\phi_{optimal}+\Delta\phi_{RF}-\omega(t_{beam}+\Sigma(2\pi/\omega_n)+t_{beam\text{-}gap})$$

Then, the phase of the RF drive at the source, at the time that the ion beam is sensed by the system, should be $$\phi_{sensor}+\phi_{optimal}+\Delta\phi_{RF}-\phi_{beam\text{-}gap}$$

where $\phi_{sensor}=\omega\ t_{sensor}$ and is the phase lag between when the ion beam is sensed by the system and when the ion beam crosses the detector, and $\phi_{beam\text{-}gap}=\omega\ t_{beam\text{-}gap}$ is the phase lag required for the ion beam to reach the accelerating gap after it passes the detector. $\phi_{beam\text{-}gap}$ is therefore just the angle between the location of the detector and the location of the gap.

It is to be understood that the above algorithm is illustrative and that alternative, equally effective, formulations to control the phase are possible. In general, the phase at the source that optimizes the beam acceleration is a function of these parameters:

$$\phi_{source}=f(\phi_{sensor},\phi_{beam\text{-}gap},\phi_{Beam},\phi_{RF},\phi_{optimal})$$

The control system of the RF drive uses a feedback system in order to control the phase and amplitude at the gap, keeping it near optimum at all times during the acceleration, injection and extraction process. The phase varies slowly compared to the beam rotation, as it takes time to effect changes in phase in resonant circuits. It is possible, however, to vary the frequency of the resonant circuit to achieve faster adjustment of phase.

As described above, in cyclotrons, it is possible to provide RF structures (cavities), instead of the use of dee's, for acceleration of the beam. In the case of cavities instead of dee's, the phase of the RF drive does not vary across the unit (that is, at resonance in a cavity, the electric field has a single phase). So it is not necessary to account for the phase differential due to delay in transmission through the slit that generates the accelerating voltage.

In the previous description, the algorithm for controlling the beam during acceleration was described. It is possible to adjust amplitude, frequency and phase of the accelerating RF field in order to adjust the extraction. In order to achieve proper extraction, the beam should arrive at the extraction region with the proper energy and with the proper direction. It may be desirable to adjust (either increase or decrease) the rate of energy increase of the ion beam as it rotates around the axis, especially when the ion beam has been excited with a non-axisymmetric component that generates betatron oscillations (precession of near circular ion orbits). The rate of energy increase can be adjusted by controlling the phase of the RF drive with respect to the ion beam, the amplitude of the accelerating RF fields, or both.

FIG. 1 illustrates one possible embodiment of the control system 100. The detector 101, which will be described later, is excited by the ion beam as it passes by. A filter or series of filters 102 process the signal, which has a built-in delay 103, due to the finite propagation speed of the signal. The signal processing unit 102 could also be an amplifier, or a differential amplifier, or it could combine the signal from multiple detectors 101. Multiple detectors 101 could be used to reduce RF interference, decreasing or eliminating the signal in the detector due to the RF fields, and detecting the beam phasing with increased signal to noise ratio. The signal is sensed by the sensor 104, which could use advanced signal processing methods, including lock-in-amplification to determine the timing/phasing of the beam and determining the phase with respect to a reference signal, not shown in the figure. The reference signal could be a different signal, but in this application, it may be useful to use the amplified signal as the reference. The electronic control unit 105 senses the shift 111 between the expected signal at the Dee's 106 with that measured by the sensor 104, and adjusts the RF generator 107 so that the desired signal will be generated at the gap in the Dee's 110 at the time when the beam is expected to pass through the Dee's. In some embodiments, the RF wave generator 107 modifies its output phase and/or amplitude in response to inputs from the electronic control unit 105. In other embodiments, the RF wave generator 107 modifies its output frequency based on inputs from the electronic control unit 105. In still other embodiments, other phase, amplitude and/or frequency can be controlled. The amplifier 108 is used to increase the power of the RF drive, while the tuner is used to adjust the frequency slightly. The RF system may actually be feeding an RF cavity that can be driving directly the gap 110 (i.e., the cavity is instead of the gap) or it could provide RF drive for the accelerating structure in the cyclotron. In the latter case, as well as when the RF system drives the dee's, there is a phase lag 109 between the amplifier 108 and the gap 110. The phase lag (RF delay) 109 could be due to finite transmission speed or due to capacitive/inductive elements in the amplifier/turner 108 or in the transmission line.

Not shown in FIG. 1 are the cyclotron main coils. These main coils surround the cyclotron, provide the magnetic field and field gradient required to confine the beam in the cyclotron and determine the final energy of the ion beam that is to be extracted. Thus, to create an ion beam of a predetermined energy, a magnetic field is established in the cyclotron by supplying a particular current to the main coils. Based on this current level, an appropriate magnetic field is created. It is this magnetic field that determines the final energy of the ion beam at extraction.

Figure 2:
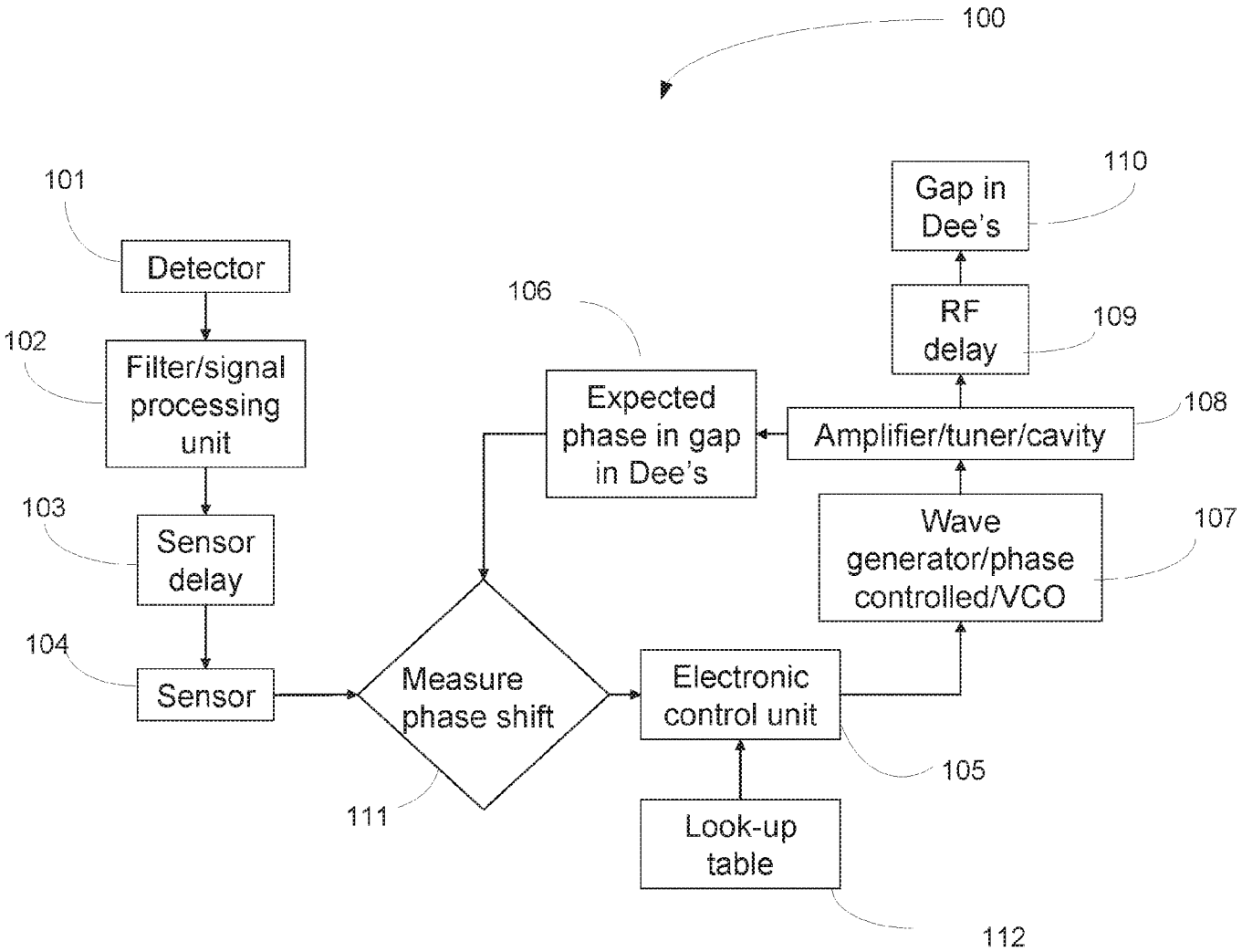
FIG. 2 is a schematic showing the presence of a look-up table to provide additional information to the control system.

During the injection, acceleration or extraction process, it may not be necessary to monitor or adjust the phase or amplitude of the RF drive every cycle, and an averaging can be used to determine the appropriate phase, amplitude and/or frequency of the wave. The longer time-scale required to vary the phase or amplitude of the ion beam allows for improved acquisition of the properties of the ion beam (through averaging), to compensate for noise in the system. In addition, a look-up table of required phase/frequencies as a function of the beam energy may be used in addition to the feedback. It may be used both to assure that the ion beam is being sensed properly, as well as to provide information when either the signal from the beam is small, or the phase measurement unit is resetting, or during times when the beam phase is difficult to determine, such as immediately following injection of the beam into the accelerating region. FIG. 2 shows the presence of the look-up table 112 in the control loop to provide the missing, or poorly measured, information and to assure proper performance of the control unit 105.

As mentioned above, some of the delays 103, 109 are a function of the ion beam energy, as the radial location of the ion beam with respect to both the sensor 104 and the accelerating Dee's changes with ion beam energy. The look-up table 112 can be used store the values of the delays, which can be either measured or calculated. In addition, it is possible to vary the optimal phase of the ion beam with energy, as the stability criteria of the ion beam changes with energy. Thus, at lower energy, it may be desirable to adjust the phase for improved bunching of the ion beam, while at higher energies, once the ion beams are relatively well bunched, the phase can be adjusted for increased acceleration voltage per pass in the Dee's. It is possible to determine the beam energy at a given revolution from the frequency of RF drive, and thus the approximate radius and location (in the case that the orbits are not quite circular and there is a precession due to betatron oscillation) of the ion beam.

In addition to monitoring the beam phase and the average increase in energy, it may be possible to measure the beam "health" (using parameters such as beam pulse height, beam pulse width and beam pulse tail). A narrow beam pulse, with no substantial tail (indicating particles that have fallen off-sync) will indicate a healthy beam. As the particles lose sync with the RF drive, they spread in angle, changing the characteristics of the signal measured by the probe (less height, more width of the signal). Further analysis of the relationship between the ion beam acceleration rate and the ion beam "health" may avoid the need to adjust for the change in the phase delays of the different elements. The purpose would be to maximize the ion beam acceleration stably, by monitoring the energy increase per revolution or per a number of revolutions, and then adjust the phase to get maximum stable acceleration with good ion beam "health." The phase of the RF drive can be adjusted using the characteristic of the beam (height, width), coupled with the measured rate of increase of energy. This approach could be used instead of using a loop-up table for control of the RF, during at least a portion of the accelerating phase of the beam.

Figure 3:
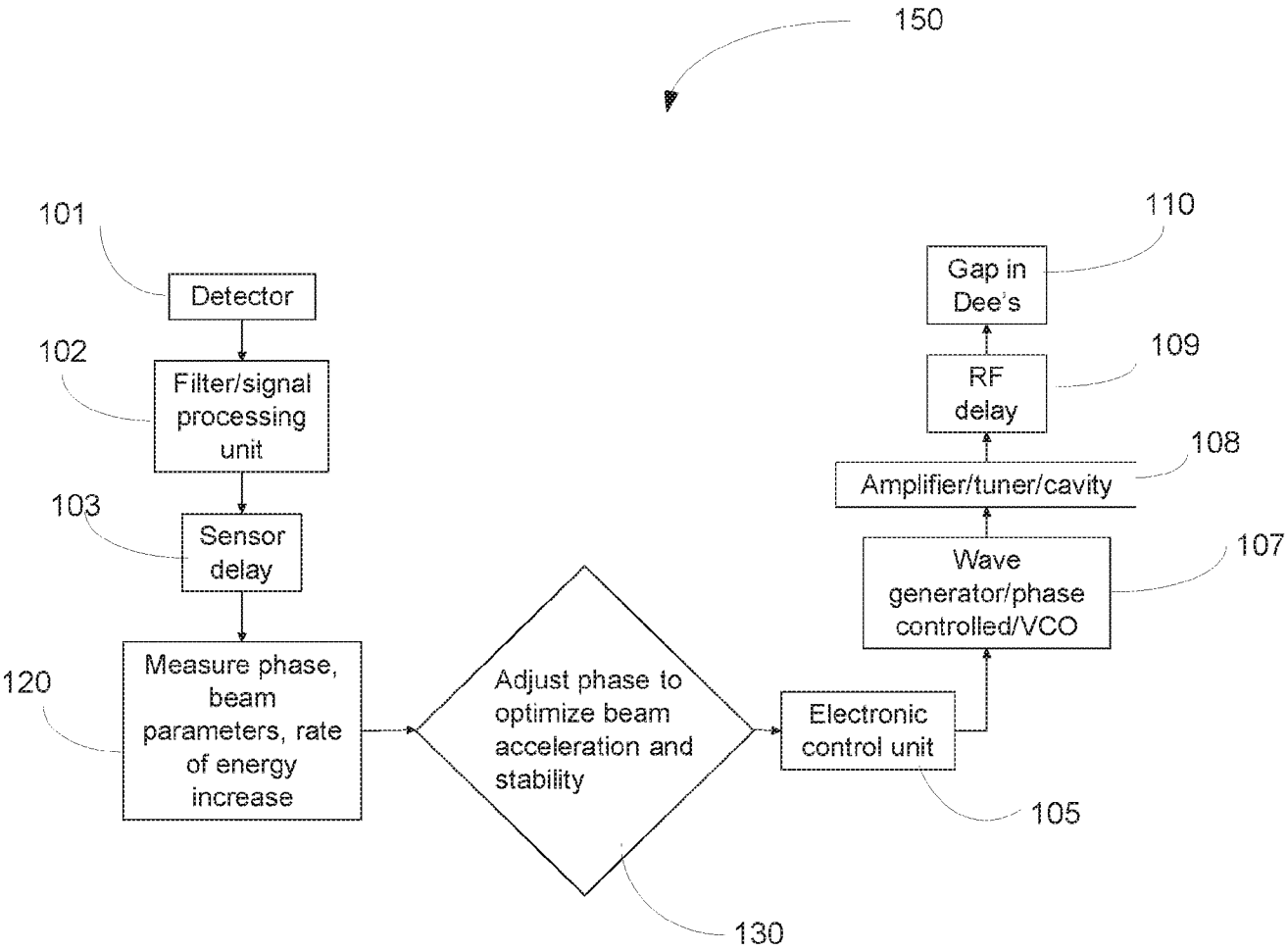
FIG. 3 is a schematic showing a monitoring system that determines the beam parameters, including phase and shape.

FIG. 3 shows an RF control system 150 that illustrates this type of control. Even though there are still sensor delays 103 and RF delays 109, by monitoring the beam parameters and the rate of energy increase, as shown in box 120, it is possible to avoid knowing how the sensor delay 103 and RF delay 109 vary with energy. The phase is "dithered" slowly around a baseline phase, as shown in box 130, and the impact on the beam acceleration monitored. The baseline phase is reset often during the acceleration process. There can be a look-up table (see FIG. 2) to aid in the acceleration process. The control system 150 can also include an adaptive system that learns, in such a way that some parameters in the look-up table are adjusted actively.

The control system 150 varies (dithers) the phase relative to a baseline phase to determine the optimal phase, and resets the baseline phase periodically during the acceleration. Because of the large number of turns during the acceleration, the optimal phase does not change significantly from one cycle to the next.

The electronic control unit 105 can either generate the signal with the proper phase, amplitude and/or frequency, or alternatively, it can adjust the parameters of conventional power supplies. For example, if the phase is lagging, it could temporarily increase the frequency of the signal in order to "catch up" with the phase. Similarly, if the phase is too advanced, the controller could reduce temporarily the frequency in order to slow down to the required phase. It should be noted that it is not necessary to provide feedback on the frequency of the signal, as control on the phase is sufficient, and an increase in frequency is similar to an increase in the rate of change of phase. A linear change in frequency can be provided by a quadratic change in phase, at otherwise constant frequency. That is, $$\exp[i(\omega_0+\Delta\omega_t)t+i\phi_0]=\exp[i\omega_0 t+i(\phi_0+\Delta\omega t^2)]$$

In principle, it may be possible to adjust the software so that, once the algorithm is determined, the continuous feedback monitoring of the ion beam is not needed, through all or part of the injection, acceleration and extraction steps. It is also possible that, once done for one machine, the same algorithm may be utilized in other machines. This approach is particularly of interest in machines that do not require iron for shaping, as it is expected that the field profiles can be reproduced very accurately between machines.

It is also possible to reset the frequency/phase of the equation, to prevent very large square times (phase shift scales as time-squared). The look-up table 112 can be useful in this process.

In the case of resonant cavities instead of dee's, the power supply changes the phase and/or the amplitude of the RF drive slowly. In the case of a RF cavity with varying resonant frequency, faster response can be achieved by modifying the cavity or the circuit properties to vary the phase of the electric field.

Beam Sensors

It is necessary to determine where the beam is with respect to the RF field. The beam sensor is a key contributor to the successful implementation of the invention.

Several sensors types are possible for this application. For example, it is possible to have one or more inductive loops. When the ion beam goes over one inductive loop, it induces an emf in the loop and delayed into the sensor. It is possible to use one or more loops. The loops can be of either planar shape, or they can be convoluted loops, as in the case of Rogowski coils. A single loop or multiple loops or coils can be used. It may be desirable to place the loop in a region where the electric field induced by the Dee's, during the time of detection, is small, to minimize pick-up of the RF drive signal by the loop. There are regions both downstream and upstream of the gap where the field is 0 during the time that the beam is transiting the cyclotron, and the loops can be placed there. Depending on the definition of $\phi_{optimal}$, the detection would occur near $\pi/2+\phi_{optimal}$ or $\pi/2-\phi_{optimal}$ away from the gap.

Another potential way to decrease noise is to use two loops, placed in such a manner that they are symmetric (and reversed) with respect to the accelerating gap. In this manner, the emf due to the accelerating voltage can be eliminated (nulled). In addition, there will be two beam pulses in the sensor per cycle, potentially improving the detection of the phase of the ion beam.

Another potential location of the loops is rotated in relation to the accelerating gap. There are two angular locations along the beam orbit where the field in the Dee's is going through reversal at the time that the beam is going through them. In these two places, the rate of change of field is small, and although the fields are high, the rate of change of field is small. Sensitivity of the detector may be improved when the loop is located in one of these two locations.

Figure 4:
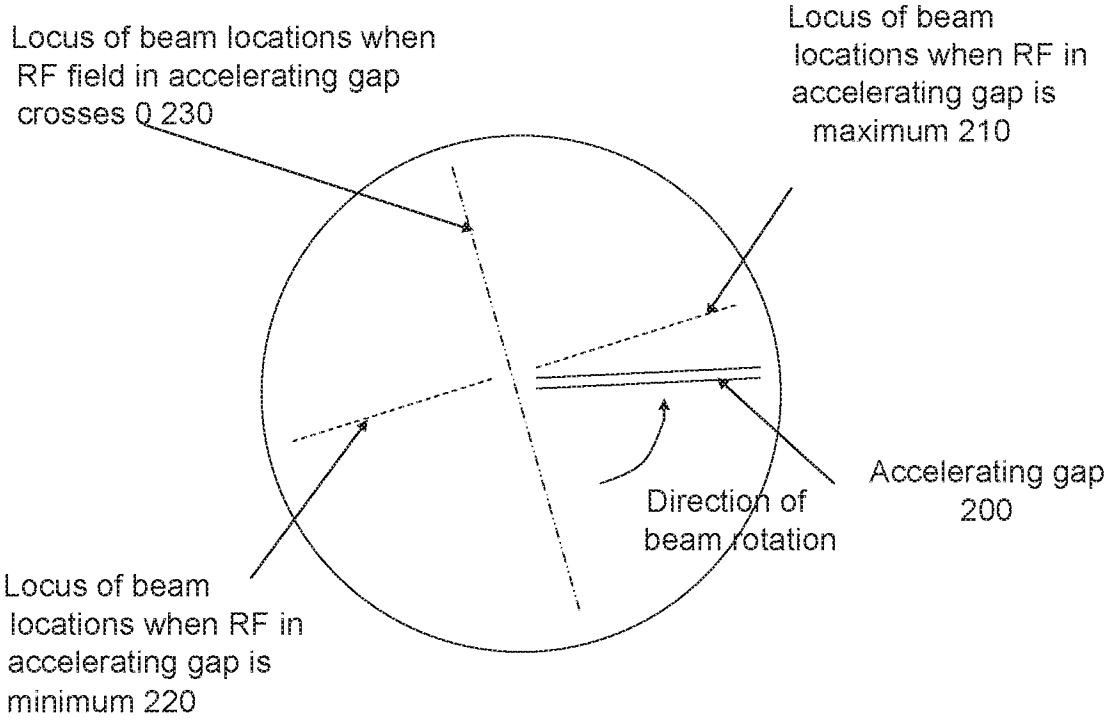
FIG. 4 shows locations for the beam with respect to the location of the accelerating gap at different phases of the accelerating RF.

FIG. 4 shows a schematic of the acceleration region of a cyclotron, showing potential locations of the loop or loops. The location of the accelerating gap 200 is indicated. For simplicity, only one acceleration gaps is shown. However, depending on the range of desired beam energies desired of the synchrocyclotron, it may be desirable to include multiple acceleration gaps and sensing loops per beam orbit to limit the demands on the required frequency range of the RF drive system. It is well known that the peak accelerating field in the gap 200 is reached after the beam has passed, for improved beam pulse (results in bunching). The locus 210 of the location of the ion beam at the time when the accelerating field in the gap is highest is shown. Also shown is the locus 220 of the location of the ion beam when the decelerating field in the gap 200 is the minimum. The ion beam is at these loci during the time when the rate of change of the RF field is a minimum.

Also shown in FIG. 4 are the loci 230 of the ion beam locations when the RF electric field is 0. It may be advantageous to place the sensor at these loci. However, in this case, the rate of change of the electric field is maximum, and if there is RF pick-up, it could generate substantial noise in the phase detection system.

Figure 5:
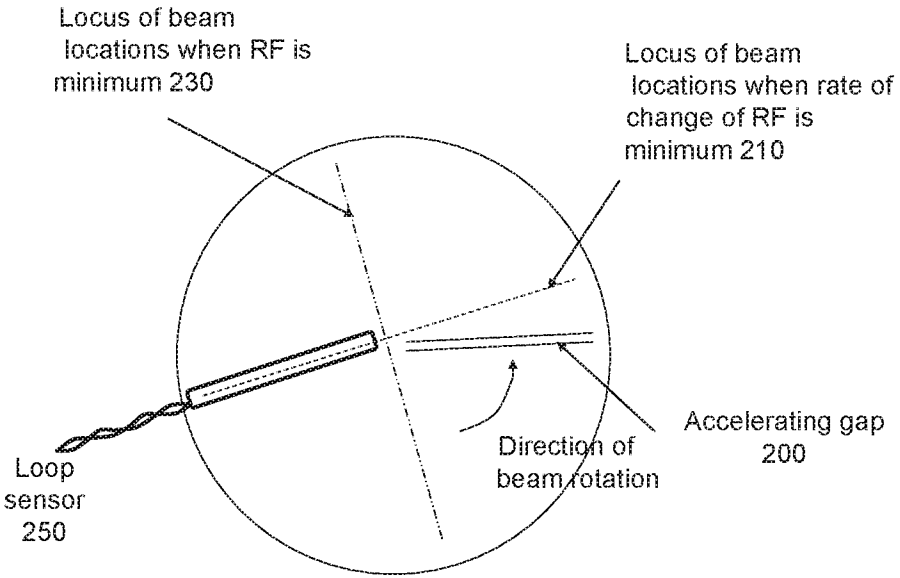
FIG. 5 shows a potential location of the loop sensor in the system.

FIG. 5 shows a detector loop 250 at one of the loci 220 of the beam location when the electric field has the minimum rate of change, which occurs, of course, at times when the RF electric field is either a maximum and a minimum. At this location, the rate of change of the RF field is at its minimum when the beam passes by the sensor 250.

Figure 6:
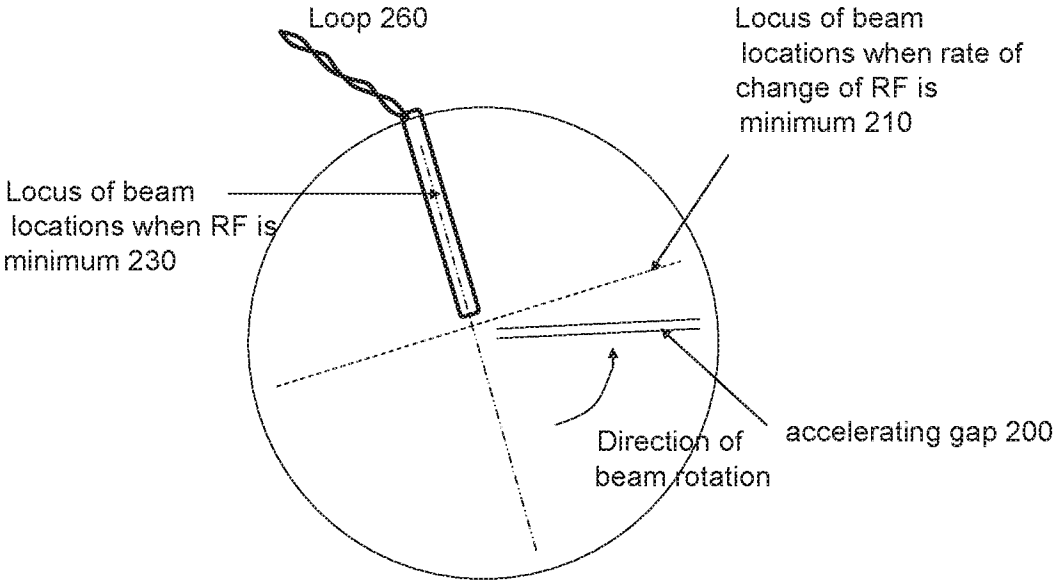
FIG. 6 shows a detection loop at one of the loci of the locations where the amplitude of the RF field is a minimum.

In accordance with another embodiment, FIG. 6 shows a detection loop 260 at one of the loci 230 of the beam when the amplitude of the electric field is minimum. At this location, the RF field is minimum when the ion beam passes by the sensor 260.

Figure 7:
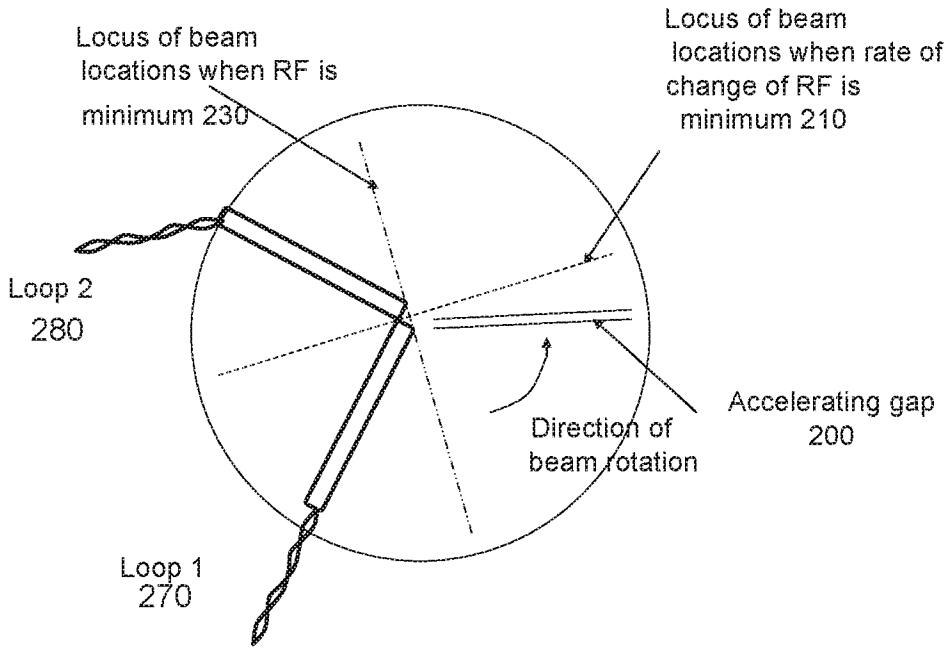
FIG. 7 shows the location of two sensors disposed in such a way that the RF pickup by the two sensors cancels each other.

FIG. 7 shows the case where more than one set of loops is used. In this case, two sets of loops 270, 280 are illustrated. The loops 270, 280 are arranged so that the rate of change of flux through one is opposite to the other, so they should show minimum coupling with the electric field. These loops 270, 280 are connected in series. In this case, there are two signals in the detection loop per cycle of the beam around the cyclotron. The loops 270, 280 may be disposed such they are the same respective angular rotation away (although in opposite directions) from the either locus 220 or locus 210.

By using the configuration of FIG. 7, the beam phase can be identified from two signals when the beam passes by each sensor 270, 280.

It should be understood that, in all of these embodiments, the term "loops" also refers to Rogowski coils. Although the loops are arranged so that the twisted pair of the current leads occurs in the large radius of the loop, other locations of the twisted pair around the loop are not excluded. Also, although the loop or Rogowski coil is shown in only half of the cyclotron, it could be placed along a diameter. In this case, it is possible to return the coil or loop through the opposite side of the beam chamber, to minimize common-noise and increase signal-to-noise ratio.

An alternative beam phase and/or position sensor is dipole antennas, which do not have loops. It is possible to use the same locations for positioning of dipole antennas, if that is the preferred detector. There are a number of antennas to be used, the simplest being the dipole antenna, which is basically a bare conductor exposed to the electromagnetic fields from the passing ion beam. Other types of electric field sensing antennas could be used. In the case of dipole antennas, it is possible to make the connection of the antenna between the antenna extremes, as shown in FIG. 8.

Figure 8:
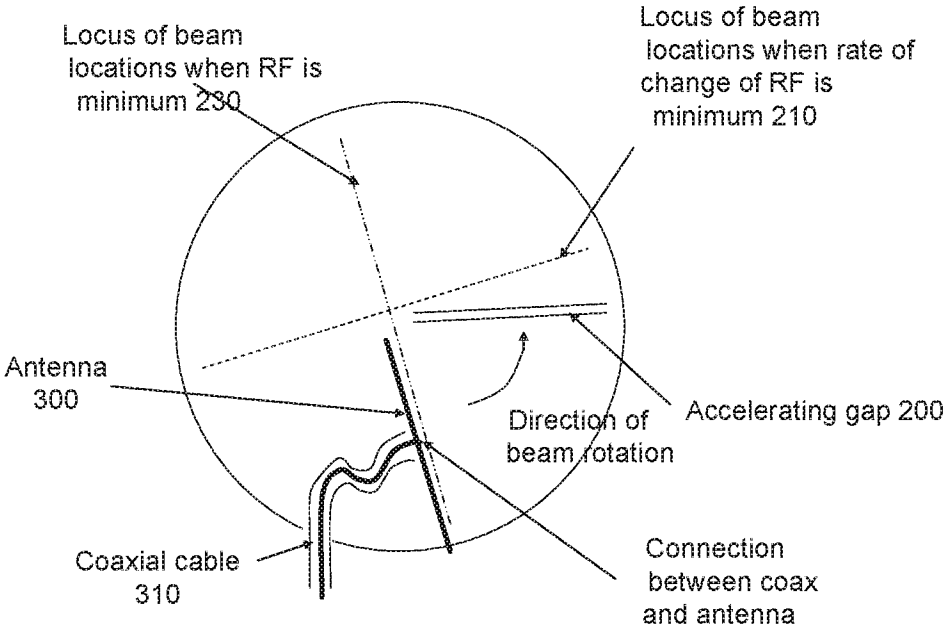
FIG. 8 shows a possible location of a dipole antenna for sensing the ion beam.

FIG. 8 shows a potential location of a dipole antenna 300 for sensing the beam. In this case, the dipole antenna 300 is located at the loci 230 where the RF is a minimum when the beam passes through. The connection to the antenna, which may be a coaxial cable 310, is not necessarily at the extreme end of the antenna 300, but it could be somewhere along the antenna 300.

Figure 10:
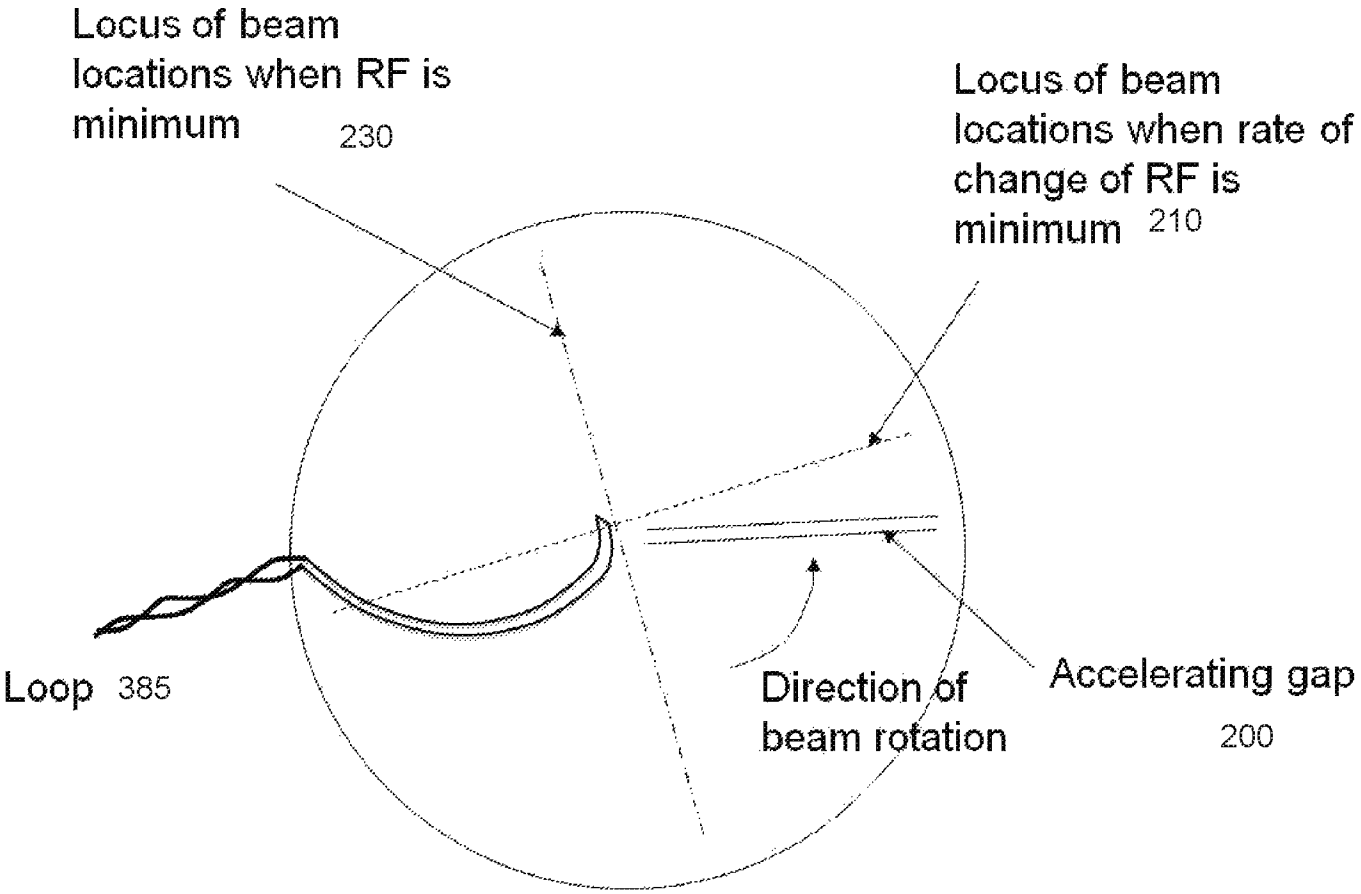
FIG. 10 is a diagram showing a beam sensor, such as a loop, that is not aligned in the radial direction.

Also, although the beam detector is shown radially in each of the embodiments illustrated in FIGS. 4-8, it may be advantageous for the detector 385 to be curved, as shown in FIG. 10.

It would be possible to build in the sensor 385, by deviating from radial, phase differentials that are dependent on the energy of the beam (higher energy beam rotates at larger radii). In this manner, for example, the change in the sensing delay $t_{sensor}$ that arises due to changes in the beam energy (and changes in radial location of the beam) can be offset by sensing the beam at an appropriate location, and there is no need for software adjustment. Also, although the accelerating gap 200 is shown radial, it is possible to include accelerating gaps that are not radial but with an azimuthal angle that varies with radius. The accelerating gap 200 is meant to include acceleration through a cavity, where the strong electric fields are produced in a cavity/resonator.

It may also be possible to build into the hardware other phase compensators. One simple phase compensator would be to utilize longer cables or provide differential impedance in the lines.

Although only dipoles and loops have been described, other types of detectors can be used, including solid state detectors, fiber optics, cloud chambers and others. It may be necessary for these sensors to have very fast response in order to determine the phase of the beam.

Similarly, sensors to determine the radial location of the beam would be needed, for applications where betatron oscillations are being used for beam extraction control. Similar sensors could be used to determine the characteristics of the betatron orbits in the cyclotron.

Adjustment During Acceleration

A very attractive feature of the invention is that closed loop control of the acceleration enables the possibility of adequate injection, acceleration and extraction in the case of varying final beam energy in a single synchrocyclotron. For some applications, including radiation beam therapy, it would be useful to modulate the energy of the ion beam, avoiding the need for a phantom or energy degrader. Variation of the extracted beam energy is enabled by the use of iron-free machines, by variation of the current in the cyclotron coils (which vary the cyclotron magnetic field amplitude while maintaining the normalized field profile). An iron-free synchrocyclotron operating in conjunction with phase-locked loop beam acceleration can readily provide the desired variation in extracted beam energy, with no additional required sub-system components.

Changing the energy of the beam requires several modifications to the cyclotron operation, some of which are enabled by the use of closed loop control. The changing of the energy of the ion beam, while maintaining the radius of extraction requires changes in the magnetic field of the device. The relativistic gyro-radius of a charged particle in a magnetic field is $r_{gyro}=\gamma\ m\ v/q\ B$, where $\gamma$ is the relativistic mass correction, m is the rest mass of the charged particle, v its velocity, q its charge and B the magnitude of the magnetic field. The energy of a particle is given by $E=mc^2(\gamma-1)$ where c is the speed of light. For non-relativistic particles, $E=\frac{1}{2}\ m\ v^2$, and the gyro-radius is given by $r_{gyro}=(2\ E\ m)^{1/2}/qB$. For a constant radius of extraction (i.e., for a given cyclotron), the energy of the particle scales as $E\sim B^2$. Thus, relatively small changes in the magnetic field result in substantial changes of the ion beam energy.

The second operational change when changing the beam energy is the adjustment of the frequency of the RF drive. For non-relativistic particles, the frequency scales linearly with the field ($f\sim B$). It may be required that the RF circuits have substantial bandwidth to accommodate the change in magnetic field. In the case of the synchrocyclotrons, the range of frequencies needs to be adjusted when the beam energy is being varied. The range of frequencies scale with the current in the cyclotron coils, that is, the lower frequency scales with the cyclotron coils current, and the highest frequency also scales with the cyclotron coils current. Thus, the total range of tunable frequencies of the RF circuit for the synchrocyclotron goes from the lowest frequency at the lowest field, to the highest frequency at the highest fields: there is a fast frequency ramp (for a given beam energy) required for acceleration of a single ion "packet", and a slower change of the frequency limits of the frequency ramp, associated with the changing magnetic field (and thus, beam energy).

It would be possible to achieve large energy variability by the use of multiple accelerating gaps, decreasing the large bandwidth of the RF required in the case of a single accelerating gap. However, this would require individual control of each gap. The process can be used either with RF cavities for the acceleration, as well as for dee's. In order to achieve lower acceleration energy, with the beam orbiting around the cyclotron at lower frequencies, instead of reducing the frequency, it would be possible to activate a cavity or a dee, and thus prevent deceleration of the beam. In this case, there would be multiple RF cycles per beam orbit for some beam energies, but only a few limited gaps would be activated to continue the acceleration (if the other cavities would be activated, the beam would decelerate while traversing the cavity or the gap between the de-activated dee's and thus, be counterproductive). By deactivating the decelerating cavities or dees, it is possible to maintain the frequency higher than otherwise would be required, limiting the required bandwidth of the accelerating RF drive. It should be noted that when the acceleration of the beam takes place during only a fraction of the RF cycles, it would be possible to accelerate multiple beam bunches. The number of potential beam bunches is the same as the number of RF cycles per orbit of the charged particles.

In other words, by applying the RF drive to multiple RF cavities along the orbital trajectory, it is possible to operate the RF drive at a frequency different than would be used if only a single acceleration gap were used. This allows the RF drive to have a narrower range of operating frequencies, as the use of multiple RF cavities causes the same effect as a change in frequency using a single injection gap.

In addition to the changing the beam energy, it is possible to adjust the RF amplitude and RF frequency to accommodate the acceleration of different particles. It is possible thus to accelerate hydrogen, deuterium or carbon. In the case of carbon, it would be desirable to accelerate $C^{6+}$, which would have similar accelerating RF frequency as deuterium because it has the same charge-to-mass ratio.

Adjustment During Injection Using an External Ion Source

In a cyclotron, it is necessary to introduce the particles to the acceleration region. Conventional methods of injection include using an electrostatic mirror or spiral inflectors. The spiral inflectors need to be readjusted to accommodate changes to the current in the cyclotron coils. A way of adjusting the parameters so that the spiral inflector is effective as the cyclotron coil current is varied is to simultaneously adjust the injected beam energy and the electric field applied to the inflector. If the cyclotron coil current changes by $\eta$, the electric field by $\eta^2$ and the injected beam energy by $\eta^2$, then the spiral inflector will remain effective as a means to introduce charged particles into the cyclotron, even though the currents in the cyclotron coils have changed.

Similarly, it would be possible to accommodate the injection with a spiral inflector for charged particles beams with a different charge-to-mass or energy, when the amplitude of the magnetic field in the cyclotron is changed. By adjusting the injected particles energy and the voltage in the inflector as the magnetic field and the charge/mass ratio changes, it is possible to introduce particles with different charge-to-mass ratio through the same inflector, with adequate efficiencies.

A simpler solution for admitting particles with different energies or different charge-to-mass ratios would be through use of an electrostatic mirror. Another alternative would be to use an internal ion source. The use of an internal source is impractical for the case of the carbon$^{6+}$ ions. It should be noted, however, than it may be possible to couple an electron beam ion trap or electron beam ion source EBIT/EBIS with a cyclotron.

Internal Ion Sources

One way to avoid the issue of injection into the cyclotron is to provide an internal ion source. Any type of ion source would be appropriate for use with a variable energy synchrocyclotron. It would be ideal to match the internal ion source to the acceptance window of the RF drive in the cyclotrons, to minimize space charge during the early stages of the ion acceleration. This is particularly important for synchrocyclotrons, as the beam acceptance duty cycle is small. It would also be ideal to use sources without electrodes, which have limited lifetime and require frequent maintenance.

In addition to ion sources that use electrodes, there is on-going development of pulsed sources, such as laser ion sources, for the generation of ions for injection into accelerating structures (either cyclotrons or RFQ's). Some of this work is relevant for the generation of low energy protons.

The choice of material to be laser ablated may be important. The material should have enough opacity that the laser beam does not pass through the material. Thus, it has been shown that C—H compounds (beeswax, polyethylene) do not show signs of break down when illuminated with about $10^9$ W/cm$^2$. In this case, there is no proton production. However, when hydrates are used that can absorb the beam energy, charged particle beams are generated, although with low efficiency. Slightly more energy, on the order of $10^{10}$ W/cm$^2$, does result in good emission, even in polyethylene. In this case, the ion energy is on the order of 150 eV, still somewhat higher than ideal for use in high performance synchrocyclotrons. In the case of the very high energy, even polyethylene can be used for the generation of protons. It should be noted that in the case of sufficient power, the addition of materials (nanoparticles) to the polyethylene does not result in improved hydrogen generation.

The issue of breakdown can be addressed by using higher frequency lasers, such as by double or, even better, tripling the frequency of infrared lasers, such as NdYAG or by placement of solid materials in the ablator material, such as nanoparticles or nanotubes. Ideally, the ion energy at the ion source should be low in order to provide higher brightness of the accelerated ion beam. Very high intensity laser ion sources (i.e., around $10^{16}$ W/cm$^2$) produce very energetic ions (up to several MeV's) and would not be accepted well by the synchrocyclotron For applications to synchrocyclotrons, an ablator that does not result in deposits that involve maintenance operation are desirable. Carbon-hydrogen ablators are not ideal in that the carbon or carbonaceous material may build in components inside the beam chamber. Hydrogen compounds that do not result in stable solids in the beam chamber are desirable. Two such compounds are water and ammonia. In both cases, the compounds need to be fed into the beam chamber in frozen condition, to minimize sublimation of the material. Limited sublimation is tolerable. To prevent sublimation of water, a temperature of around 200 K or lower is desirable. Similarly, ammonia needs to be kept cold in order to prevent sublimation. In both cases, the water or its byproducts (oxygen ions, atoms and water clusters) and ammonia and its byproducts, (nitrogen, ammonium clusters, etc) would not build up in the machine.

Ideally the internal ion source would be located along the axis, near the midplane of the machine.

Beam Extraction

The extraction of an ion beam presents the largest challenge for variable energy, iron-free synchrocyclotrons. Beam extraction over the course of a few orbits by perturbing the local magnetic field near the extraction radius is one possibility. The required perturbation should be produced by an element that is linear with the cyclotron magnetic field, such as superconducting monoliths, or a small wound coil, whose field could be programmed to match other characteristics of the machine.

The inventors have demonstrated that if the magnetic field and the RF voltage are adjusted, it is possible to maintain identical orbits in a synchrocyclotron, starting from the same position and with adjusted initial energy, through changes in the currents in the cyclotron coils. The algorithm for achieving identical orbits is the same as that described above for the acceleration. Thus, it may be possible to maintain identical orbits, including the extraction. However, it is likely that because of the large number of cycles, it will be necessary to adjust either the amplitude, phase or both of the accelerating voltage to make sure that the orbits ahead of the extraction, and during extraction, stay the same for similar beam extraction (for particles with different energy or even charge-to-mass ratios).

Figure 9:
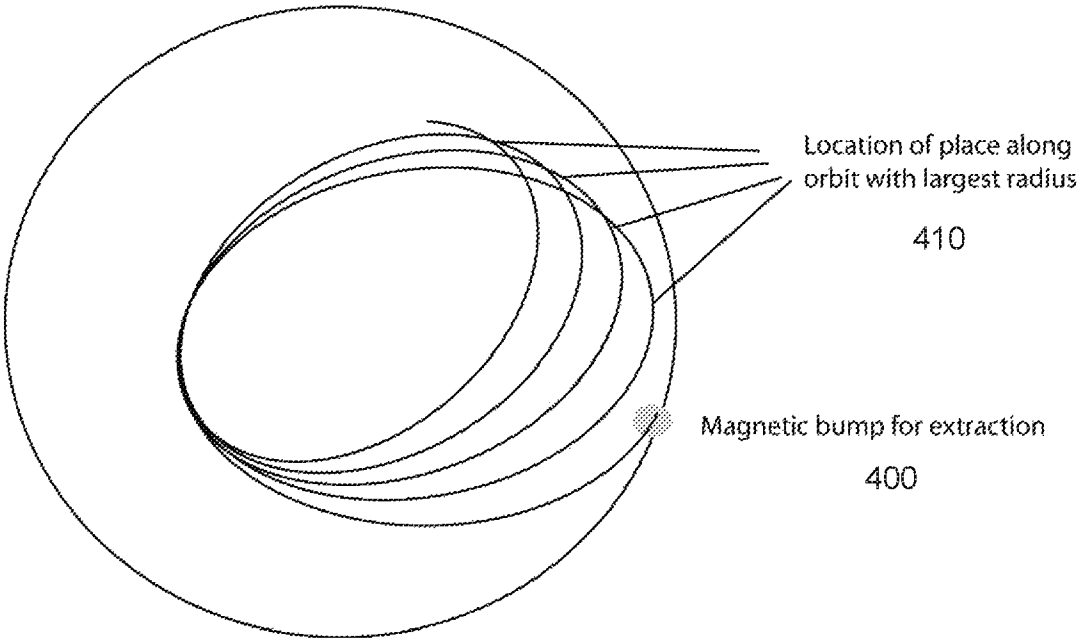
FIG. 9 is an illustrative figure showing means of increasing the turn-to-turn distance ahead of the extraction of the beam.

An alternative solution is to combine betatron oscillations with phase-locked loop control of the acceleration as shown illustratively in FIG. 9. FIG. 9 is a schematic of feedback control of the beam extraction, where the amplitude of a magnetic bump is adjusted to control the location of the extraction of the beam. The magnetic bump could be a single magnetic bump, or it could interact with a second bump that accomplishes the extraction.

The betatron oscillations rotate the point on the orbit with the largest radius (the cyclotron orbits having a center that is different from the magnetic field center). The location 410 of the point in the orbit with the largest radius, and the precession of this largest radii over several orbits, are shown in FIG. 9. Also shown in the location of the extraction bump 400 that is introduced to extract the beam. FIG. 9 exaggerates the orbit separation as well as the precession, in order to illustrate the adjustment needed on the orbit in order to achieve appropriate extraction. By adjusting the RF drive during the acceleration period (both the amplitude of the electric field as well as the phase with respect to the beam), especially towards the end of the acceleration process, it is possible to have the particles with the right energy at the right location (radial and azimuthally) for extraction. Much larger separations may be possible by using this technique, as multiple accelerations can happen between adjacent trajectories in the same outermost location. The extraction method uses the betatron oscillation, slower than the cyclotron orbit frequency, to adjust when the particles reach full energy and can enter the extraction boundary. It is thus possible to adjust the location of the extraction. Increased beam extraction efficiency can be achieved in this manner.

It is also possible to increase the RF accelerating field during the extraction process, in order to increase the turn-to-turn separation. By increasing the RF field only during the last stages of the acceleration, it is possible to keep the average power requirements low. It may not be necessary to increase the power handling capacity of the power supply, as the peak is only needed only during a small fraction of the beam injection, acceleration and extraction periods, so operation at this high power has low duty cycle.

The amplitude of the betatron oscillation can be adjusted by introducing the beam into the cyclotron such that the center of the gyrotron motion of the ions is displaced with respect to the magnetic axis of the cyclotron, or through controlled magnetic perturbations in the cyclotron field. The betatron oscillations can be adjusted by modification of the profile of the magnetic field, which is possible in the case of a device without iron. It can be produces also by linear magnetic elements (linear in that they can be varied with the magnetic field) that introduce non-axisymmetric magnetic fields in the cyclotron.

FIG. 9 is an illustrative figure showing means of increasing the turn-to-turn distance ahead of the extraction of the beam. Beam sensors (not shown) are used to determine the location of the beam, and the phase, amplitude or both of the acceleration electric field (through dee's or cavities) is adjusted in order to provide beam with the right energy and location at the extraction site (accelerating structure is not shown in FIG. 9)

The above discussions provide means of controlling the energy of the beam during the precessions due to betatron oscillations (by adjusting the phase and/or amplitude of the RF field). It is possible, however, to excite betatron oscillations that will result in beam extraction by adjusting the amplitude of a pulsed non-axisymmetric field in the cyclotron.

As an alternative or in addition to conventional means that use a stationary magnetic bump (with a field that varies linearly with the main field of the cyclotron, adjusted to obtain variable energy), the phase loop control (that provides information on the status of the ion bunch) allows the possibility of extraction by the use of a rapidly changing kicker magnetic field. This kicker field is a non-axisymmetric pulsed magnetic field generated by one or more coils, referred to as the kicker coils. Rapidly means on the scale of several cyclotron orbits, or several precession orbits (of the betatron oscillations). Non-axisymmetric means that the perturbation varying field has an azimuthal variation. An advantage of using a kicker field for extraction is that the beam orbits are not perturbed until the beam reaches the desired extraction energy. The kicker field may require multiple orbits of the ions through the cyclotron for extraction, and it is not limited to a single orbit before extraction.

One issue with this approach is the power required to rapidly vary the magnitude of the kicker field. One embodiment that allows the rapid change of the magnetic kicker field is to use a set of kicker coils (that generate a pulsed non-axisymmetric perturbation magnetic field) that have zero mutual inductance to the main cyclotron coils. There could be one or multiple coils, with multiple loops, with currents connected in series. The arrangement could include a set of non-axisymmetric field-generating coils that are identical, but rotated around the major axis of the cyclotron and operating with current flowing in the opposite direction (handedness). There could be a set of two non-axisymmetric coils or a larger set of coils, with an even number of perturbation coils. Alternatively, it could be through the use of external transformers to zero the mutual inductance between the two coils. In another embodiment, a combination of the two approaches may be used that result in zero mutual inductance between the two coil sets. Because the zero mutual inductance, the energy required to generate the kicker fields scales as the square of the perturbation field, and it is much smaller than it would be if the mutual inductances were not low. The absence of iron in the circuit eases the control of the beam variation (eliminates the non-linear element), as well as reduces potential losses due to the fast varying rates.

It is possible that the kicker coils are symmetric with respect to the midplane, in which case there may be a set of 4 coils, or they could be one above (the kicker coil) and the other one (the compensation kicker coil) below the midplane, with the main cyclotron windings in series, in which case, the mutual inductance of both coils sets (the kicker coils and the main cyclotron coils) is 0.

The ramp rate of the kicker field, as well as time of initiating the ramp (with respect to the beam energy and the phase in the orbit where the ramping of the non-axisymmetric field starts) can be adjusted to provide adequate extraction of the beam. A look-table may be generated that provides information on the ramp rate and the timing of the ramp for several beam energies. Information from the beam sensor (location, energy) can be used to initiate the ramping of the kicker field. The ramp rate can also be adjusted by using information from the beam sensor, using phase-locked loop techniques. Alternatively, the ramp rate is adjusted as the magnetic field is varied, in order to adjust the trajectory of beams of different energies so that the orbits of beam of different energies are the same. By assuring that the beam trajectories are the same for conditions of different beam energies, it is assured that the ion beam extraction is the same for ion beams having different energies.

Magnetic field variations on the superconducting coils can be prevented by thin conducting elements that shield the superconducting coils from the coils that generate the kicker fields.

Because the kicker coils are pulsed, it is possible to produce relatively high fields for short periods of time, higher than would be possible with conventional magnetic field bumps. The coils could be superconducting, but resistive coils, with short pulse duration, are also feasible, enabled by the low duty cycle of the kicker coils.

An alternative embodiment of the design is to use a pulsed electrostatic deflector to perturb the beam optics leading to the extraction point. For an electrostatic deflector, there is no inductive coupling with the main magnetic field. The energy required to activate the electrostatic deflector is very small compared with the energy required for the magnetic perturbation fields, even in the case of no coupling between the non-axisymmetric perturbation fields and the main cyclotron coils.

Figure 11:
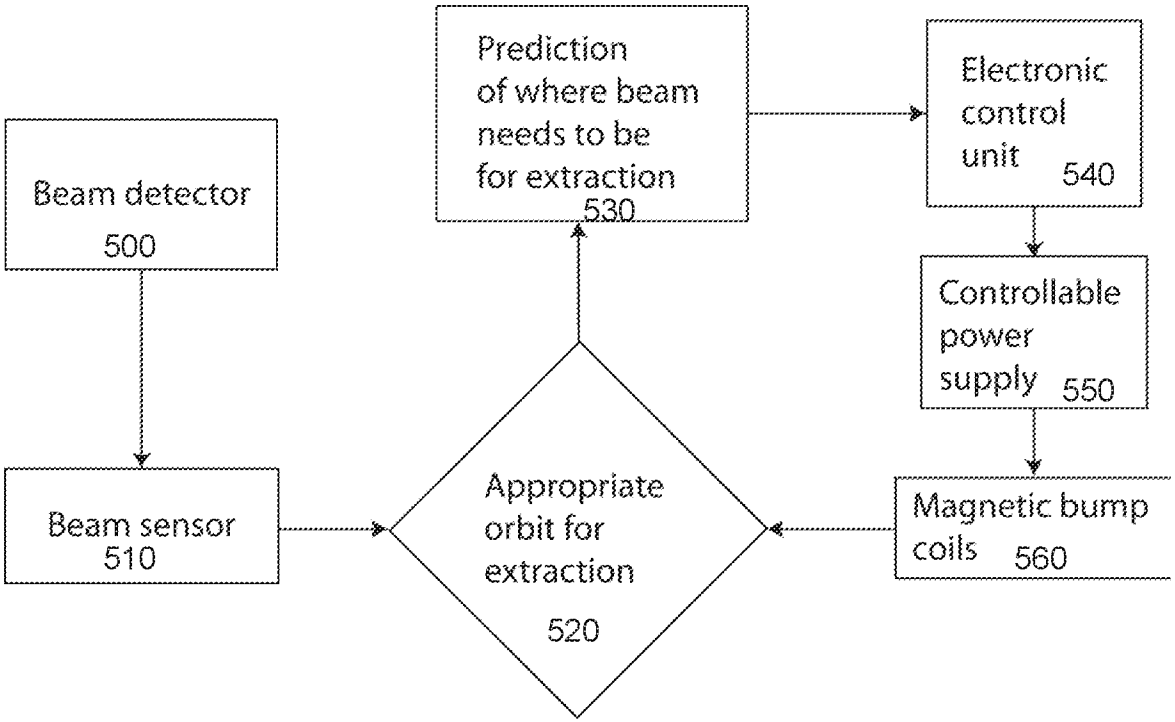
FIG. 11 shows an illustrative control algorithm that can be used to control the amplitude of the non-axisymmetric field to provide adequate extraction.

FIG. 11 shows an illustrative control algorithm that can be used to control the amplitude of the non-axisymmetric field to provide adequate extraction. This scheme allows control of the perturbation fields (magnetic bump) in order to provide adequate ion orbits for extraction, during the final stages of acceleration of the beam. As the location of the beam is known in real time through the beam sensor 510 (that may include more than one detector 500), the field perturbation required to provide an approach to the extraction region that results in good beam extraction can be calculated, and the perturbation (non-axisymmetric) field required to achieve the orbit modification is then activated. The situation is dynamic, and further estimates of the ion beam path and required field perturbations can be calculated in real time. For example, the position and speed of the beam can be determined using the beam detector 500 and beam sensor 510. To successfully extract the beam, its orbit during the last few cycles must be altered in a predictable manner. For example, based on a lookup table or a second phase lock loop, the electronic control unit 540, which may be the same electronic control unit as described in reference to FIG. 1, may make a prediction of where the beam needs to be at a particular time for extraction (see Box 530). The electronic control unit 540 then communicates with a controllable power supply 550 to alter the magnetic bump coils 560. The actuation of these coils 560 serves to alter the orbit 520 of the ion beam. Based on the new orbit, the electronic control unit 540 again predicts where the beam needs to be (see Box 530), and alters the power supplied to the magnetic bump coils 560.

Although FIG. 11 shows the use of magnetic bump coils to alter the orbits of the ion beam, it is understood that any orbit altering mechanism, or any non-axisymmetric field modifier may be used. For example, in addition to magnetic bump coils, a pulsed electrostatic deflector or a rapidly changing non-axisymmetric pulsed magnetic field generated by coils may be used.

Figure 12:
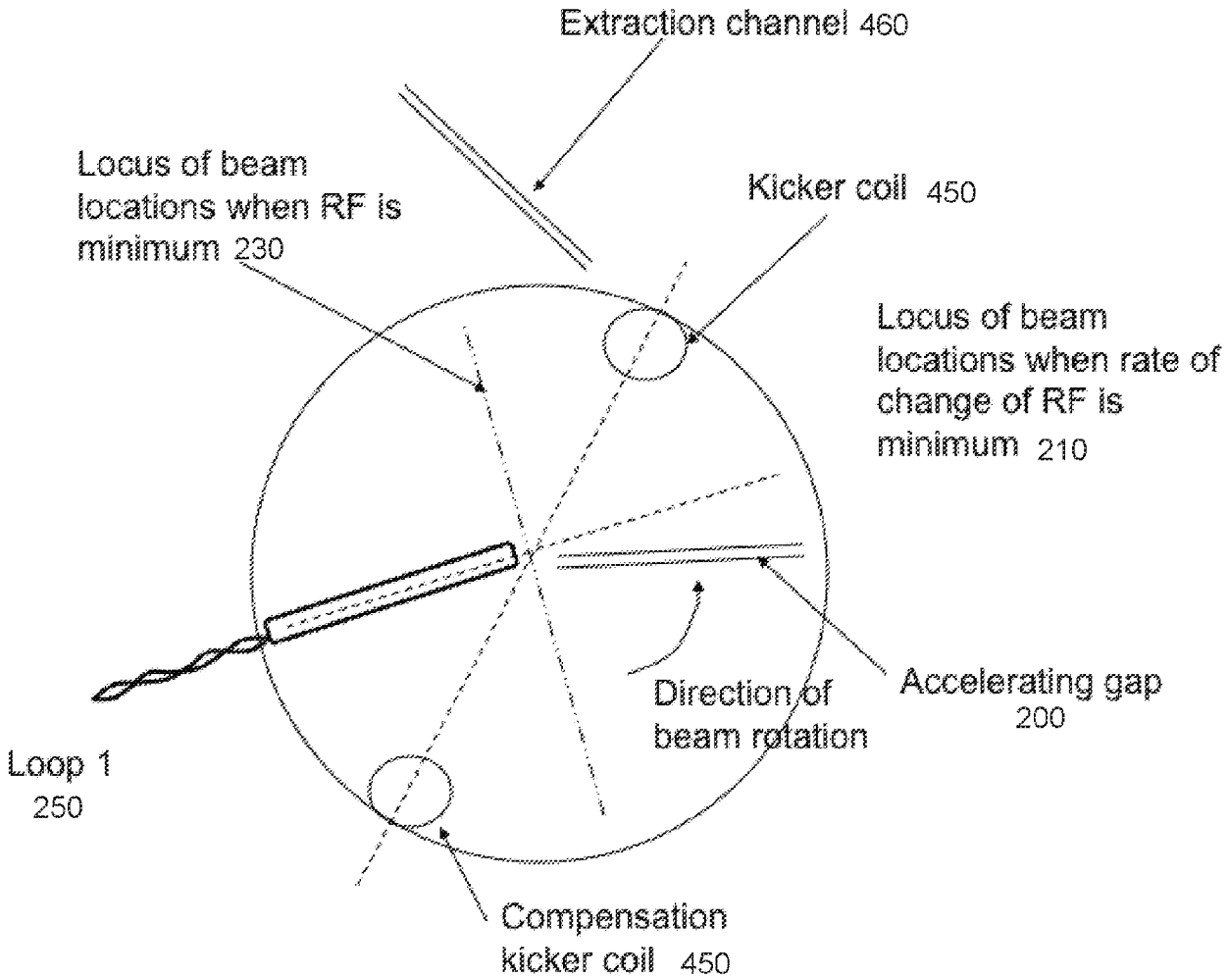
FIG. 12 shows a system having a acceleration gap, an extraction channel and kicker coils to alter the orbits of the ion beam during the extraction process.

Thus, in some embodiments, the cyclotron may include at least two functions. These two functions are shown in FIG. 12. First, the cyclotron must accelerate the ion beam to a predefined energy level or acceleration. Second, the cyclotron must extract this ion beam through an extraction channel 460. The use of phase locked loops may make both functions more predictable. As described above, and shown in FIGS. 1-3, the cyclotron may include a beam detector 101, a beam sensor 104, an electronic control unit 105, an RF wave generator/phase controller VCO 107 and an amplifier 108. FIG. 12 shows a potential location of loop antenna 250, although other positions may also be used. These components allow the cyclotron to monitor the orbits of the ion beam during the acceleration phase. Thus, by used of the phase locked loop, it is possible to determine the exact position and velocity of the ion beam within the cyclotron during the acceleration phase. In addition, the electronic control unit is able to adjust or change the ion beam orbit, velocity or position, by modifying the RF drive, which may be injected at accelerating gap 200.

This knowledge of exact beam position and velocity may allow more predictable and repeatable extraction to occur. As shown in FIG. 9, for proper extraction, the orbit of the ion beam must be altered, such that it moves further out on one side. This asymmetric orbit is used to bring the ion beam closer and closer to the extraction point. This asymmetry is created through the use of a non-axisymmetric field modifier. This field modifier, which may be implemented in a variety of ways, must insure that the ion beam follows the predetermined path for successful extraction. In one embodiment, shown in FIG. 12, the field modifier may be implemented as a set of kicker coils 450.

In one embodiment, the field modifier is an open loop system. By knowing the exact position and velocity of the ion beam within the cyclotron, it is possible to actuate the field modifier when the ion beam is at a specific position and velocity. If the field modifier is actuated in a repeatable fashion, and the ion beam is positioned at the same position and velocity when this actuation occurs, the ion beam may follow the predetermined path needed for successful extraction through the extraction channel 460. In other words, by using the phase locked loop to get the ion beam to a specific position and velocity, the extraction process may be made repeatable. This open loop behavior may also be made possible as the extraction portion of the process may only constitute a few orbits, such as less than 100. Thus, in this embodiment, the electronic control unit may utilize a look up table or other information to control the field modifier. This look up table or other information may utilize data, such as mass of ions, mass/charge ratio of ions, and the desired energy of extracted ion beam in determining the appropriate control of the field modifier.

In another embodiment, a second phase locked loop is used to control the field modifier. Just like a phase locked loop is used to control the RF drive during acceleration, a phase locked loop can control the non-axisymmetric field modifier during extraction. In this embodiment, a beam detector and sensor is user to determine the location and speed of the beam. An electronic control unit then utilizes this information to determine the appropriate alterations for the field modifier. These alterations are also based on data such as mass of ions, mass/charge ratio of ions, and the desired energy of extracted ion beam. All of this information is used in determining the appropriate control of the field modifier. These changes are then applied to the field modifier accordingly. As described above, this field modifier may be a set of kicker coils 460, as shown in FIG. 12. However, other mechanisms may also be used to modify the field for extraction.

Although a discussion of implementation of phase lock loop in some instances in this disclosure refers to dee's for the accelerating structure, it is to be understood that the same principle applies when using RF cavities. Thus, the phase locked loop techniques described herein can be used with any suitable accelerating device.

Thus, the present system allows for the creation of a system which can extract an ion beam having any desired energy. As stated above, the magnetic field, which is created by passing current through the cyclotron coils, is established to confine the ion beam in the cyclotron. The magnitude of this magnetic field also establishes the final energy of the extracted ion beam.

The cyclotron also includes a phase locked loop which monitors the position and velocity of the ion beam in the cyclotron and adjusts the RF drive according to the ion beam information. The phase locked loop includes a beam detector, sensor, electronic control unit, and a RF wave generator. Based on the data received from the beam detector, the electronic control unit alters the RF drive using the RF wave generator. The phase locked loop is used to cause the ion beam to follow a predetermined path within the cyclotron.

Once the ion beam reaches a specific location and velocity within the cyclotron, the electronic control unit commences the extraction process. This may be done by actuating a non-axisymmetric pulsed magnetic field using kicker coils. This non-axisymmetric pulsed magnetic field shifts the ions beam toward the extraction point, such that the ion beam exits the cyclotron having a specific trajectory. The magnitude of the magnetic field from the kicker coils varies in direct proportion to the magnitude of the magnetic field in the cyclotron to ensure that the extracted beam follows a fixed trajectory out of the cyclotron regardless of final energy.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A method of creating and extracting an ion beam having a predetermined energy from a synchrocyclotron, comprising:

introducing ions into said synchrocyclotron;

using a RF drive to accelerate the ions to move as an ion beam in said synchrocyclotron;

sensing a position of said ion beam within said synchrocyclotron relative to a phase of the RF drive during said acceleration;

using said position of said ion beam within said synchrocyclotron relative to a phase of the RF drive to alter said RF drive to maintain a desired acceleration; and extracting said ion beam.

2. The method of claim 1, further comprising establishing a magnetic field in said synchrocyclotron by applying a current to cyclotron coils, said magnetic field used to determine said predetermined energy of said ion beam.

3. The method of claim 1, wherein said RF drive comprises a frequency, a phase and an amplitude, and wherein said phase of said RF drive is altered.

4. The method of claim 1, wherein said RF drive comprises a frequency, a phase and an amplitude, and wherein said frequency of said RF drive is altered.

5. The method of claim 1, wherein said RF drive comprises a frequency, a phase and an amplitude, and wherein said amplitude of said RF drive is altered.

6. The method of claim 1, wherein said ion beam is extracted by actuating a non-axisymmetric pulsed magnetic field.

7. The method of claim 6, wherein said non-axisymmetric pulsed magnetic field is actuated when said ion beam reaches a predetermined position and velocity.

8. The method of claim 6, wherein said actuating is performed using open loop control.

9. The method of claim 8, where said open loop control utilizes information selected from the group consisting of ion mass, ion mass/charge ratio and desired ion beam energy, to actuate said magnetic field.

10. The method of claim 6, wherein said actuating is performed using phase locked loop control.

11. The method of claim 1, wherein said predetermined energy of said ion beam is used to determine how said RF drive is to be altered.

12. A synchrocyclotron, comprising:

a beam detector disposed within the synchrocyclotron so as to detect the presence of an ion beam;

a beam sensor in communication with said beam detector;

a RF wave generator having a variable amplitude, phase or frequency output; said output defined as RF drive;

a RF cavity or dee in communication with said RF drive; and an electronic control unit in communication with said beam sensor and having outputs in communication with said RF wave generator so as to control said RF drive, thereby controlling velocity and position of said ion beam based on a position of the ion beam within said synchrocyclotron relative to a phase of the RF drive.

13. The synchrocyclotron of claim 12, further comprising a kicker coil to generate a non-axisymmetric pulsed magnetic field to extract said ion beam.

14. The synchrocyclotron of claim 13, wherein said electronic control unit is in communication with said kicker coil, and actuates said kicker coil when said ion beam reaches a predetermined position and velocity.

15. The synchrocyclotron of claim 14, wherein said electronic control unit utilizes open loop control to actuate said kicker coil to generate said magnetic field.

16. The synchrocyclotron of claim 15, where said open loop control comprises information selected from the group consisting of ion mass, ion mass/charge ratio and desired ion beam energy.

17. The synchrocyclotron of claim 14, wherein said electronic control unit utilizes information from said beam sensor to actuate said coil to generate said magnetic field.

18. The synchrocyclotron of claim 12, where said beam detector is disposed at a location where a rate of change in said RF drive is a minimum.

19. The synchrocyclotron of claim 12, where said beam detector is disposed at a location where said RF drive is a minimum.

20. The synchrocyclotron of claim 13, further comprising a cyclotron coil used to generate a magnetic field so as to confine said ion beam and determine a final energy of said ion beam upon extraction, and a second kicker coil so that said kicker coil and said second kicker coil have zero mutual inductance to said cyclotron coil.

* * * * *